United States Patent [19]

Grabbe et al.

[11] Patent Number: 4,895,522

[45] Date of Patent: Jan. 23, 1990

[54] PRINTED CIRCUIT BOARD COAXIAL CONNECTOR

[75] Inventors: Dimitry G. Grabbe, Middletown; Iosif Korsunsky, Harrisburg, both of Pa.

[73] Assignee: AMP Incorporated, Harrisburg, Pa.

[21] Appl. No.: 298,376

[22] Filed: Jan. 18, 1989

[51] Int. Cl.[4] ..... H01R 17/18

[52] U.S. Cl. ..... 439/63; 439/78; 439/581

[58] Field of Search ..... 439/63, 78, 82, 580, 439/581

[56] References Cited

U.S. PATENT DOCUMENTS

| | | | |
|---|---|---|---|
| 4,506,939 | 3/1985 | Faulkenberry et al. | 439/63 |
| 4,664,467 | 5/1987 | Tengler et al. | 439/581 |
| 4,795,352 | 1/1989 | Capp et al. | 439/63 |

*Primary Examiner*—Joseph H. McGlynn
*Attorney, Agent, or Firm*—James M. Trygg

[57] ABSTRACT

A connector (28) for use with a printed circuit board (26) and adaptable for single or double sided use as a signal launcher or feed-through, respectively. The connector includes an outer sleeve element (58) and a center contact element (46) which has a support portion (54) extending through an aperture (40) in the printed circuit board. The distal end (68) of the contact element (46) is secured by interference fit with a locking ring (72) on the other side of the circuit board.

7 Claims, 4 Drawing Sheets

PRINTED CIRCUIT BOARD COAXIAL CONNECTOR

BACKGROUND OF THE INVENTION

This invention relates to printed circuit board connectors and, more particularly, to an improved coaxial connector for use with a printed circuit board and adaptable for single or double sided use.

In present day computers, which use very large scale integrated (VLSI) circuits, signal propagation times are very critical. In particular, it is essential to provide close and accurate timing for pulse coincidence at the inputs to logic gates. At a minimum, a pulse overlap of two thirds of the signal width is required in order to get useful pulse coincidence, since smaller overlaps lead to low confidence levels and errors. In many present day computers, the pulse width is on the order of two nanoseconds or less, and the propagation delay in the interconnecting media, whether circuit boards or cables, has a significant impact on the timing after repair or replacement of a board. As a further complication, the accuracy of pulse coincidence is subject to degradation when a semiconductor device on a board is replaced, since switching times and propagation delays of complex semiconductors may vary from device to device.

In older slower systems, pulse coincidence was achieved by varying the conductor length in the interconnecting media. In other words, the interconnecting media was treated as a variable delay line. However, when the pulse width is very narrow, the tolerance range is also narrow and cannot be satisfactorily handled by a fixed length delay line. Since the lengths of the conductors on a printed circuit board are not adjustable, then if a component is replaced by one with a different propagation delay, timing adjustments must be made. These adjustments frequently have to be made in the field, not at the point of manufacture, and require an external adaptation of the delay line. Such adaptation is typically accomplished by trimming the length of either twisted pairs or a coaxial cable to a length which provides the necessary time delay to assure pulse coincidence.

As previously described, the ability to be able to adjust timing is fast becoming a necessity for many of the logic connections on the printed circuit boards of computers. Accordingly, what is required is a coaxial connector (frequently referred to as a launcher) which can be installed at various locations on the printed circuit board. This installation must be accomplished in the field. Present coaxial connectors (or launchers) are typically bulky devices, consisting of a machined casting or part, which is of substantial bulk, occupies substantial space, and represents substantial cost. It is therefore a primary object of this invention to provide a signal launcher for a printed circuit board which is of low cost, low bulk and installable at high density.

It is another object of this invention to provide such a signal launcher which may be installed in the field with automatic compensation for board thickness variation.

It is a further object of this invention to provide such a signal launcher which requires no soldering upon installation.

It is still another object of this invention to provide such a signal launcher which can be installed on either side of the printed circuit board.

It is yet another object of this invention to provide a signal launcher which can be installed on both sides of a printed circuit board to provide a signal feed-through.

SUMMARY OF THE INVENTION

The foregoing and additional objects are attained in accordance with the principles of this invention by providing a coaxial connector for mounting on a printed circuit board. The printed circuit board has a dielectric substrate of a defined thickness, a conductively plated aperture through the substrate, a conductive signal pad on a first surface of the substrate adjacent to the aperture and in electrical contact with the plating in the aperture, and a conductive ground pad on the first surface adjacent to and spaced from the signal pad. The inventive connector includes a central conductive contact element including a signal pin portion and an elongated support portion. The cross-sectional dimensions of the support portion are such that the support portion fits freely into the aperture with minimum clearance therebetween. The length of the support portion is sufficiently greater than the defined thickness of the substrate to accommodate boards of different thickness. The connector also includes an insulated annular disc member surrounding the contact element. A conductive outer sleeve element surrounds the contact element and the disc member. The internal dimension of the sleeve element is substantially equal to the outer diameter of the disc member, the sleeve element being formed with an inwardly directed end adapted to lie between the disc member and the substrate in electrical contact with the ground pad while being spaced from the signal pad. For holding the connector on the circuit board, the connector also includes securing means mounted on the support portion for exerting a force thereon to place the inwardly directed end of the sleeve element in compression between the disc member and the substrate.

In accordance with an aspect of this invention, the inwardly directed end of the sleeve element is formed with a plurality of outwardly extending spring members.

In accordance with another aspect of this invention, the securing means comprises an annular ring press fit onto the distal end of the support portion and a Belleville or similar deformed spring washer surrounding the support portion between the annular ring and the substrate.

In accordance with a further aspect of this invention, the surface of the substrate opposite the first surface has thereon a second conductive signal pad adjacent to the aperture and in electrical contact with the plating therein and a second conductive ground pad adjacent to and spaced from the second signal pad. The support portion of the contact element is of sufficient length to act as a second signal pin portion and the securing means comprises an annular ring press fit onto the support portion. There is further provided a second insulated annular disc member surrounding the support portion between the securing means and the opposite substrate surface. There is also provided a second conductive outer sleeve element surrounding the support portion and the second disc member, the internal dimension of the second sleeve element being substantially equal to the outer diameter of the second disc member, the second sleeve member being formed with an inwardly directed end adapted to lie between the second disc member and the second substrate surface in electrical contact with the second ground pad while being spaced from the second signal pad.

In accordance with yet another aspect of this invention, the disc members are interchangeable and the sleeve elements are interchangeable.

In accordance with still a further aspect of this invention, the securing means further comprises first and second shoulder portions formed on the contact element, the second shoulder portion being positioned between the signal pin portion and the first shoulder portion and having an outer dimension greater than the outer dimension of the first shoulder portion, the first shoulder portion having an outer dimension greater than the dimension of the aperture. The disc member surrounds the first shoulder portion, with the inner diameter of the disc member being greater than the outer dimension of the first shoulder portion and less than the outer dimension of the second shoulder portion, the outer diameter of the disc member being greater than the outer dimension of the second shoulder portion.

BRIEF DESCRIPTION OF THE DRAWINGS

The foregoing will be more readily apparent upon reading the following description in conjunction with the drawings in which like elements in different figures thereof have the same reference numeral and wherein.

DETAILED DESCRIPTION

Figure 1:
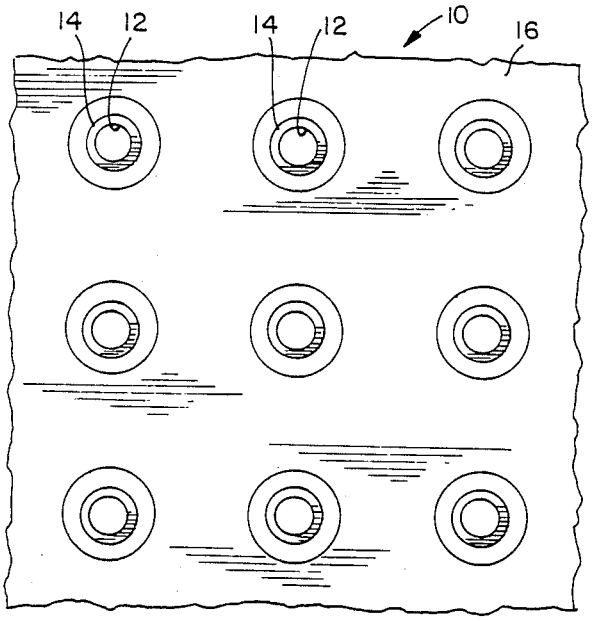
FIG. 1 illustrates a typical printed circuit board pattern using what is known as a common ground.

Referring to the drawings, FIG. 1 shows a surface of a printed circuit board 10 with a plurality of apertures 12 through the board 10. The apertures 12 are internally plated with conductive material and are surrounded by conductive signal pads 14 which are in electrical contact with the plating in the respective apertures 12. Surrounding and spaced from the signal pads 14 is a conductive ground plane 16. The printed circuit board shown in FIG. 1 illustrates a printing pattern known as a common ground, where the ground plane 16 is common to all of the apertures 12 and signal pads 14.

Figure 2:
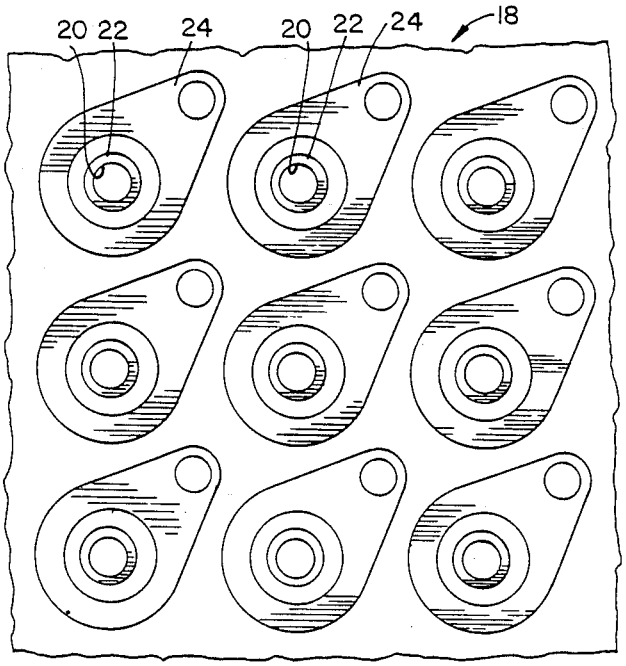
FIG. 2 illustrates a typical printed circuit board pattern for a true coaxial connection.

FIG. 2 shows a printed circuit board 18 with a conductive pattern for coaxial connections. Thus, there are a plurality of internally plated apertures 20 surrounded by signal pads 22 in electrical contact with the aperture plating. Surrounding and spaced from the signal pads 22 are a plurality of conductive ground pads 24, each individual to a respective one of the apertures 20 and signal pads 22. In any event, the inventive arrangement to be described hereinafter may work with either of the patterns of FIG. 1 or FIG. 2.

Figure 3:
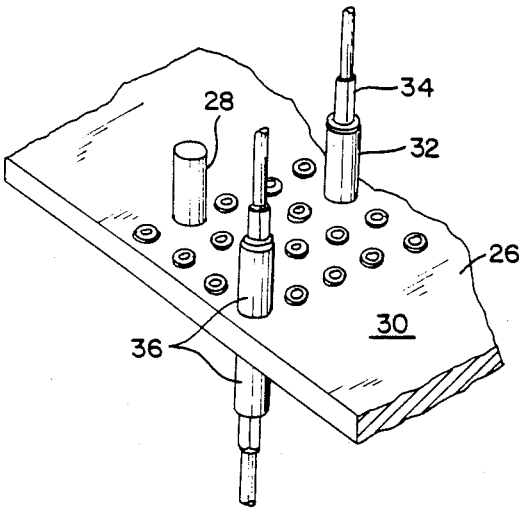
FIG. 3 is a perspective view of a circuit board showing connectors according to this invention mounted thereon.

FIG. 3 shows a portion of a printed circuit board 26 having a number of connectors according to this invention mounted thereon. Thus, the connector 28 is shown mounted on the first surface 30 of the circuit board 26; the connector 32 is also shown mounted on the first surface 30 but with a connector 34 matingly engaged therewith. The connectors 28 and 32 act as signal launchers with respect to the circuit board 26. Also shown in FIG. 3 is a connector 36 installed on both sides of the circuit board 26 so that it functions as a feedthrough.

Figure 4:
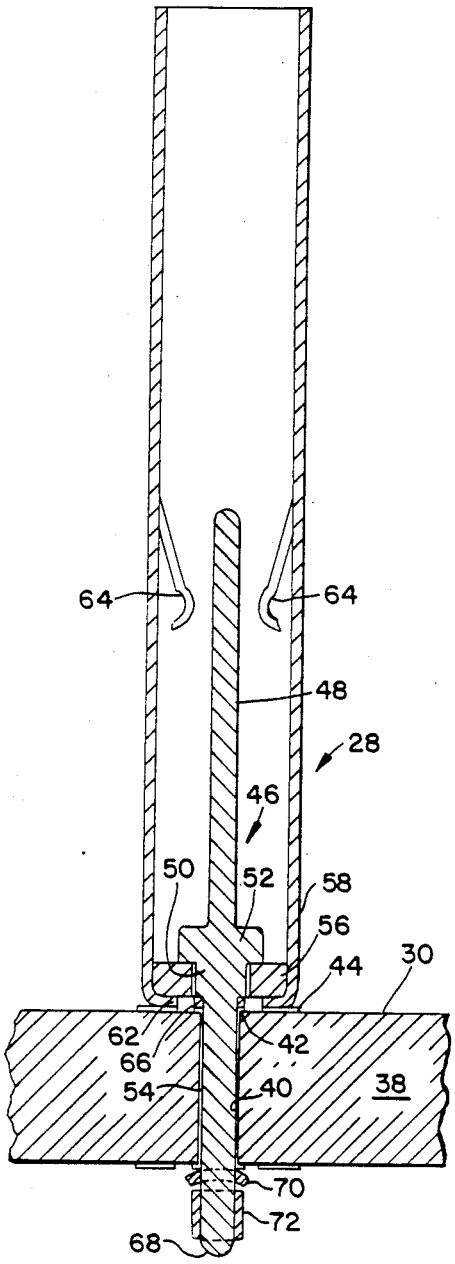
FIG. 4 is a cross-sectional view of a connector according to this invention mounted to a single side of a printed circuit board.

FIG. 4 is a longitudinal cross-sectional view through the connector 28 installed on the first surface 30 of the circuit board 26. Thus, the circuit board 26 has a dielectric substrate 38 and a conductively plated aperture 40 through the substrate 38. A conductive signal pad 42 on the surface 30 surrounds the aperture 40 and is in electrical contact with the plating in the aperture 40. A conductive ground pad 44 is also on the surface 40 and surrounds and is spaced from the signal pad 42. Although the pad 44 is described as surrounding the pad 42, it is only necessary that it be adjacent to and spaced from the pad 42, "surrounding" being only a specific example of such adjacency. Similar comments apply to the pad 42 and the aperture 40.

The connector 28 is made up as an assembly of different parts. The first part is a central conductive contact element 46 which has a signal pin portion 48, a first shoulder portion 50 of enlarged cross-section, a second shoulder portion 52 of enlarged cross-section relative to the first shoulder portion 50, and an elongated support portion 54. The contact element 46, as well as the entire connector 28, is preferably of circular cross-sectional configuration so as to display axial symmetry. The cross-sectional dimension of the support portion 54 is such that the support portion 54 fits freely into the aperture 40 with minimum clearance therebetween. This minimum clearance allows contact between the support portion 54 and the aperture plating. The length of the support portion 54 is greater than the thickness of the substrate 38. In fact, this length is such that various thicknesses of substrate may be accommodated by the connector. The first shoulder portion 50 has a diameter greater than the diameter of the aperture 40. The second shoulder portion 52 is on the other side of the first shoulder portion 50 from the support portion 54 and has a diameter greater than that of the first shoulder portion 50.

Surrounding the first shoulder portion 50 is an insulated annular disc member 56. The disc member 56 is preferably made of a physically strong dielectric material such as, for example, ceramic. The thickness of the disc member 56 is substantially equal to the length of the first shoulder portion 50. The inner diameter of the disc member 56 is greater than the diameter of the first shoulder portion 50 so that the disc member 56 fits freely thereover, but at the same time, this inner diameter is less than the diameter of the second shoulder portion 52 so that the disc member 56 is constrained thereby. The outer diameter of the disc member 56 is greater than the diameter of the second shoulder portion 52.

Figure 6:
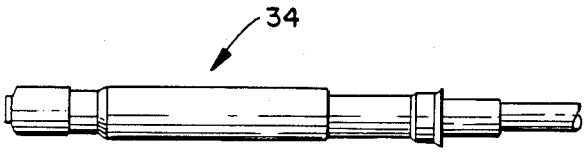
FIG. 6 shows a female termination of a conductor for use with the connector of this invention.
Figure 4A:
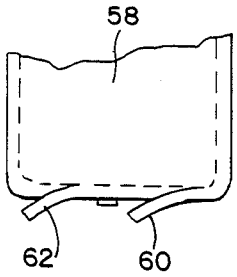
FIG. 4A shows a detail of an end of the sleeve element of the connector shown in FIG. 4.

Surrounding the contact element 46 and the disc member 56 is a conductive outer sleeve element 58, the inner diameter of which is slightly greater than the outer diameter of the disc member 56. The end of the sleeve element 58 which is adjacent the surface 30 is bent inwardly, as is clearly shown in FIG. 4A, and is formed with a plurality of outwardly extending spring members 60. The purpose of the spring members 60 is to provide a compliant stored energy spring contact to assure good electrical contact with the ground pad 44. The end 62 of the sleeve element 58 from which the spring members 60 are formed has a central opening to allow passage therethrough of the contact element 46, as well as to provide spacing from the signal pad 42. The sleeve element 58 is further formed with a plurality of inwardly extending spring members 64 which serve the dual purpose of mechanically retaining the female connector 34 inserted in the sleeve element 58 and providing an electrical connection from the sleeve element 58 to the sleeve of the female connector 34. Such a female connector 34 is illustrated generally in FIG. 6. Surrounding the support portion 54 between the first shoulder portion 50 and the surface 30 is a center contact spring 66, which is a deformed spring washer, preferably a Belleville washer. This provides further contact between the contact element 46 and the signal pad 42, in addition to the contact between the support portion 54 and the aperture plating.

To secure the connector 28 on the printed circuit board 26, means are mounted on the distal end 68 of the support portion 54 to cooperate with the first 50 and second 52 shoulder portions so as to exert a force to maintain the end 62 of the sleeve element 58 in compression between the disc member 56 and the substrate 38. This securing means includes a Belleville or similar deformed spring washer 70 and an annular ring 72. The washer 70 has an inner diameter large enough to fit freely over the distal end 68. The ring 72 has an inside diameter slightly smaller than that of the distal end 68 so that assembly is achieved by means of a press fit which provides a severe interference fit between the ring 72 and the distal end 68. During assembly, the washer 70 is placed in compression, which forces the ring 72 and the distal end 68 away from the printed circuit board 26. This causes the second shoulder portion 52 to bear down against the disc member 56 and place the end 62 of the sleeve element 58 in compression. Likewise, the first shoulder portion 50 presses down on the contact spring 66, placing it in compression as well. The compression of the end 62 and the spring 66 helps to insure good contact with the ground pad 44 and the signal pad 42, respectively. To insure secure mounting, the retention force due to the interference between the ring 72 and the distal end 68 must be substantially higher than the stored energy of the compressed washer 70, which is contemplated to be on the order of 500 grams.

Figure 5:
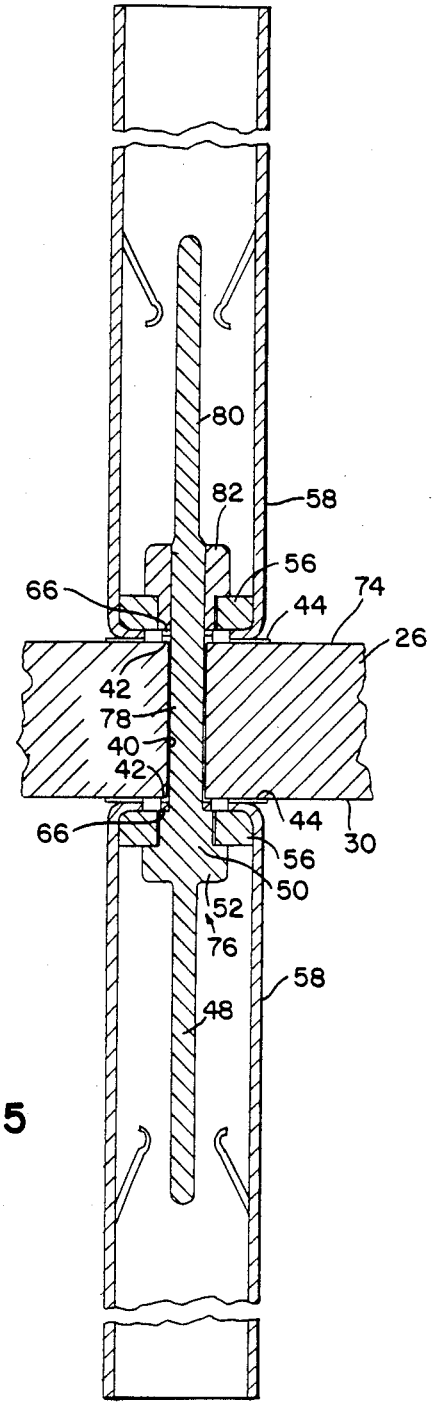
FIG. 5 is a cross-sectional view of a connector according to this invention installed on both sides of a printed circuit board.

The aforedescribed arrangement functions as a signal launcher wherein signals can either be extracted from the printed circuit board 26 or injected into the printed circuit board 26. This connector can be installed in the field without soldering at any location where there is an aperture through the printed circuit board. Many times however, it is desirable to be able to provide a feed-through from one side of the printed circuit board to the other. A modification to the aforedescribed connector to provide this function is illustrated in FIG. 5. Thus, as shown therein, there is provided for the first surface 30 and the second surface 74 of the substrate 38 a pair of interchangeable sleeve elements 58, discs 56, and center contact springs 66. A modified center contact element 76 is provided, the end of which associated with the surface 30 being identical to that corresponding end for the connector shown in FIG. 4. However, the modified center contact 76 shown in FIG. 5 has a substantially elongated support portion 78 which terminates in a slightly reduced diameter signal pin portion 80. To secure the assembly shown in FIG. 5, the ring 72 shown in FIG. 4 is replaced with a differently shaped locking ring 82 which, in addition to provided an interference fit with the support portion 78, takes over the functions of the first and second shoulder portions 50 and 52 for that side of the assembly. When the assembly shown in FIG. 5 is installed, the ring 82 is press fit onto the support portion 78 so that the washers 66 are maintained in compression. This insures good contact between the signal and ground pads on both sides of the circuit board 26 and the connector assembly elements.

There has thus been described an improved printed circuit board coaxial connector which is adaptable for signal or double sided use. While a preferred embodiment has been disclosed, it will be apparent to one of ordinary skill in the art that various modifications and adaptations to the disclosed arrangement can be made, without departing from the spirit and scope of this invention, which is only intended to be limited by the appended claims.

We claim:

1. A coaxial connector (28) for mounting on a printed circuit board (26), said printed circuit board having a dielectric substrate (38) of a defined thickness, a conductively plated aperture (40) through said substrate, a conductive signal (42) pad on a first surface (30) of said substrate adjacent to said aperture and in electrical contact with the plating in said aperture, and a conductive ground pad (44) on said first surface adjacent to and spaced from said signal pad, said connector comprising:

a central conductive contact element (46) including a signal pin portion (48) and an elongated support portion (54), the cross-sectional dimension of said support portion (54) being such that said support portion (54) fits freely into said aperture (40) with minimum clearance therebetween and the length of said support portion (54) being greater than said defined thickness;

an insulated annular disc member (56) surrounding said contact element (46);

a conductive outer sleeve element (58) surrounding said contact element (46) and said disc member (56), the internal dimension of said sleeve element (58) being slightly greater than the outer diameter of said disc member (56), said sleeve element (58) being formed with an inwardly directed end (62) adapted to lie between said disc member (56) and said substrate (38) in electrical contact with said ground pad (44) and spaced from said signal pad (42); and securing means (70, 72) mounted on said support portion (54) for exerting a force thereon to maintain said inwardly directed end (62) of said sleeve element (58) in compression between said disc member (56) and said substrate (38).

2. The connector according to claim 1 wherein said inwardly directed end (62) of said sleeve element is formed with a plurality of lanced outwardly extending spring members (60).

3. The connector according to claim 1 wherein said securing means comprises an annular ring (72) press fit onto the distal end of said support portion (54) and a deformed spring washer (70) surrounding said support portion (54) between said annular ring and said substrate (38).

4. The connector according to claim 3 wherein said securing means further comprises first (50) and second (52) shoulder portions formed on said contact element (46), said second shoulder portion (52) being positioned between said signal pin portion (48) and said first shoulder portion (50) and having an outer dimension greater than the outer dimension of said first shoulder portion (50), said first shoulder portion (50) having an outer dimension greater than the dimension of said aperture (40), said disc member (56) surrounding said first shoulder portion (50), the inner diameter of said disc member (56) being greater than the outer dimension of said first shoulder portion (50) and less than the outer dimension of said second shoulder portion (52), the outer diameter of said disc member (56) being greater than the outer dimension of said second shoulder portion (52).

5. The connector according to claim 1 wherein:

the surface (74) of said substrate opposite said first surface (30) has thereon a second conductive signal pad (42) adjacent to said aperture (40) and in electrical contact with the plating therein and a second conductive ground pad (44) adjacent to and spaced from said second signal pad (42);

said support portion (78) of said contact element is of sufficient length to act as a second signal pin portion (80);

said securing means comprises an annular ring (82) press fit onto said support portion (78);

there is provided a second insulated annular disc member (56) surrounding said support portion (78) between said securing means (82) and said opposite surface (74); and there is provided a second conductive outer sleeve element (58) surrounding said support portion (78) and said second disc member (56), the internal dimension of said second sleeve element (58) being substantially equal to the outer diameter of said second disc member (56), said second sleeve member (58) being formed with an inwardly directed end (62) adapted to lie between said second disc member (56) and said opposite surface (74) in electrical contact with said second ground pad (44) and spaced from said second signal pad (42).

6. The connector according to claim 5 wherein said securing means further comprises first (50) and second (52) shoulder portions formed on said contact element (46), said second shoulder portion (52) being positioned between said signal pin portion (48) and said first shoulder portion (50) and having an outer dimension greater than the outer dimension of said first shoulder portion (50), said first shoulder portion (50) having an outer dimension greater than the dimension of said aperture (40), said disc member (56) surrounding said first shoulder portion (50), the inner diameter of said disc member (56) being greater than the outer dimension of said first shoulder portion (50) and less than the outer dimension of said second shoulder portion (52), the outer diameter of said disc member (56) being greater than the outer dimension of said second shoulder portion (52).

7. The connector according to claim 5 wherein said disc members (56) are interchangeable and said sleeve elements (58) are interchangeable.

* * * * *